US006053078A

United States Patent [19]

Parker et al.

[11] Patent Number: 6,053,078

[45] **Date of Patent: *Apr. 25, 2000**

[54] WRENCH FOR SOFT GOLF SPIKES

[75] Inventors: James Parker, Basking Ridge; Jeffrey St. Thomas, Ramsey, both of N.J.

[73] Assignee: PST Products, Inc., Basking Ridge, N.J.

[ * ] Notice: Under 35 U.S.C. 154(b), the term of this patent shall be extended for 459 days.

[21] Appl. No.: 08/718,122

[22] Filed: Sep. 18, 1996

[51] Int. Cl.[7] ..... B25B 23/00

[52] U.S. Cl. ..... 81/461; 81/176.15; 81/451

[58] Field of Search ..... 81/176.1, 176.15, 81/176.2, 176.3, 461, 441, 451

[56] References Cited

U.S. PATENT DOCUMENTS

| | | | |
|---|---|---|---|
| 141,908 | 8/1873 | Ackerman . | |
| 168,357 | 10/1875 | Uster . | |
| 1,129,049 | 2/1915 | Smith . | |
| 1,397,876 | 11/1921 | Meldal . | |
| 2,442,920 | 6/1948 | DeVries | 81/176.1 X |
| 3,043,171 | 7/1962 | Lederer | 81/176.15 |
| 3,604,488 | 9/1971 | Wishart | 81/451 |
| 3,633,640 | 1/1972 | Moore | 81/451 |
| 3,903,762 | 9/1975 | Acrea . | |
| 4,584,914 | 4/1986 | Hall et al. | 81/176.15 |
| 4,664,000 | 5/1987 | Bainbridge | 81/451 |
| 5,003,681 | 4/1991 | Schley | 81/176.1 X |
| 5,072,634 | 12/1991 | Ryder . | |
| 5,272,943 | 12/1993 | Edwards . | |
| 5,284,072 | 2/1994 | Smith . | |
| 5,450,776 | 9/1995 | Kozak | 81/451 |
| 5,458,026 | 10/1995 | Southard et al. . | |

FOREIGN PATENT DOCUMENTS

| | | | |
|---|---|---|---|
| 948413 | 1/1949 | France | 81/461 |
| 21772 | 7/1898 | United Kingdom | 81/176.15 |

*Primary Examiner*—D. S. Meislin

*Attorney, Agent, or Firm*—Arthur L. Plevy; Buchanan Ingersoll PC

[57] ABSTRACT

A wrench for threading and unthreading soft golf spikes in and out of golf shoes, having a circular body with a first end surface, a second end surface. The includes a plurality of prongs projecting a predetermined length from the second end surface, wherein each of the prongs has a sharp pointed tip for penetrating a soft golf spike. The wrench further includes a cylindrical wall depending from the second end surface for automatically aligning the prongs of the wrench over a soft golf spike to be threaded or unthreaded in or out of a golf shoe.

19 Claims, 3 Drawing Sheets

WRENCH FOR SOFT GOLF SPIKES

FIELD OF THE INVENTION

This invention relates generally to hand tools and in particular, to a wrench for threading and unthreading a soft golf spike in and out of the heel and/or sole of a golf shoe.

BACKGROUND OF THE INVENTION

Golf shoes and other types of athletic footwear, are provided with cleats or spikes for enhancing the traction of users wearing such footwear when participating in various athletic activities. The cleats or spikes are typically attached to the soles and heels of the shoes using threaded male-female fastener arrangements. Such fastener arrangements typically consist of a plurality of internally threaded inserts disposed in the heel and sole of each golf shoe. The spikes each have a base with a threaded post extending from the base in a direction opposite from the spike. Each spike is attached to the shoe by threading the post of the spike into one of the internally threaded inserts disposed in the sole or heel of the golf shoe, and detached from the shoe by unthreading the post of the spike from its associated insert. This requires applying a turning or rotational torque to the golf spike to thread and unthread it from the insert. Accordingly, various means in the form of slots, apertures and the like, have been provided on the base of the golf spike to enable the application of the turning torque to the spike to thread and unthread it from the insert. Hand tools of various sorts for aiding in the threading and unthreading golf spikes, have been designed to engage such means so that the additional torque provided by such tools can be applied to the spike.

During normal use of the golf shoes, the golf spikes wear out, bend, break, or chip and thus, must be replaced. In the past, the spikes were made from metal and therefore, corroded over the normal course of use because of the spike's placement at the bottom of the shoe. Moreover, water, dirt, chemicals and other foreign substances foul the area of engagement between the spike and its associated threaded insert, thus, even with the use of the aforementioned hand tools, removal of the spikes can require the use of extreme force or even power tools. Further, worn out or broken spikes may result in wearing or partial destruction of the threaded inserts, and/or the hand tool engaging means on the base of the spike, all of which make unthreading more difficult.

More recently, the problem of corrosion and spike breakage has been addressed by golf spikes made from a soft, pliable plastic material, which are known in the art as "soft golf spikes." An example of a soft golf spike is shown in FIGS. 1A–1C and designated by numeral 10. As shown, the soft golf spike 10 has a circular base 12 with an outer diameter D of just under ⅞" and a beveled edge 18. Eight (8) spaced-apart, wedge-shaped protrusions 14 extend radially in a spiraling manner from the center of the base 12 on a first side thereof and an externally threaded post 16 extending from the center of the base 12 on a second side thereof. The dimensions of the externally threaded post 16 are sized such that the post 16 can be received in a standard internally threaded insert found in the sole and heels of a typical golf shoe. Since the protrusions 14 are made from a soft plastic material, they tend to be prone to excessive wear which requires frequent replacement of the spike 10. This excessive wearing of the protrusions 14 of the spike 10 is illustrated by FIGS. 1B and 1C, where FIG. 1B depicts a new soft golf spike with full height protrusions 14, and FIG. 1C depicts a well used soft golf spike with excessively worn protrusions 14.

Existing spike removing hand tools similar to the ones shown in U.S. Pat. No. 5,284,072 to Smith, U.S. Pat. No. 5,272,943 to Edwards, U.S. Pat. No. 5,072,634 to Ryder, and U.S. Pat. No. 3,903,762 to Acrea, are presently used for threading and unthreading soft golf spikes from their associated internally threaded inserts disposed in the sole and heels of conventional golf shoes. The hand tools shown in these patents generally include a pair of blunt-ended pins or fingers which are spaced apart such that the pins can be received in the apertures of a conventional spike to thread and unthread the spike from its insert. When such spike removing hand tools are used to install or remove a soft golf spike, each blunt-ended pin or finger is inserted between a pair of the protrusions on the soft golf spike. However, the excessive wear and tear of the protrusions and the accumulation of dirt between the protrusions combine to make it nearly impossible to use existing hand tools to unthread the worn soft golf spike from its associated insert because the blunt-ended pins slip easily out of the space between the worn down protrusions when a rotational torque is applied thereto.

Accordingly, there is a need for an improved hand-tool for threading and unthreading soft golf spikes in and out of the heel and/or sole of a golf shoe which substantially avoids the problems associated with prior art hand-tools.

SUMMARY OF THE INVENTION

A wrench for threading and unthreading soft golf spikes in and out of golf shoes, comprising a circular body having a first end surface, a second end surface; at least three prongs projecting from said second end surface; and self-aligning means for automatically aligning said at least three prongs of said wrench over a soft golf spike to be threaded or unthreaded in or out of a golf shoe.

In one embodiment of the present invention, gripping means are disposed on a cylindrical outer side surface defined by the circular body and self-aligning means for enabling a user to grip and rotate said wrench.

In another embodiment of the present invention, male-end receiving means are defined in the first end surface for receiving a detachable drive handle.

In another embodiment of the present invention a drive handle extending from the first end surface is provided.

In still another embodiment of the present invention, the three prongs each have a sharp pointed tip for penetrating the soft golf spike.

In a further embodiment of the present invention, the at least three prongs comprise four prongs.

BRIEF DESCRIPTION OF THE DRAWINGS

For a detailed understanding of the present invention, reference should be made to the following detailed description taken in conjunction with the accompanying drawings wherein.

DETAILED DESCRIPTION OF THE INVENTION

Figure 4A:
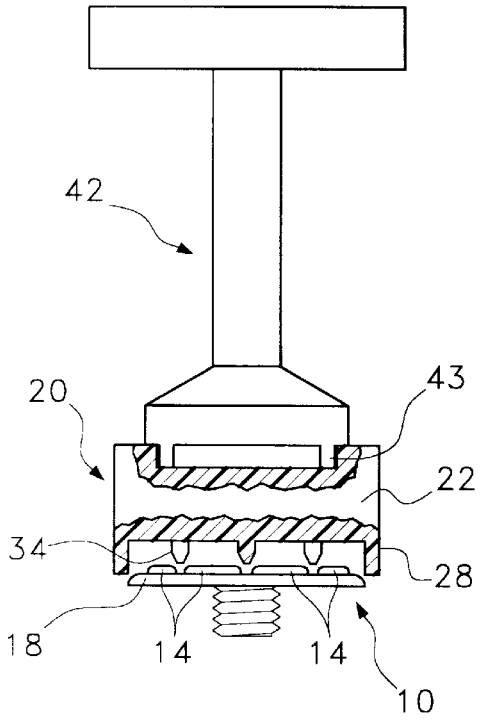
FIGS. 4A and 4B depict how the cylindrical wall depending from the second end surface of the circular body of the wrench operates to automatically align the working end thereof over a soft golf spike especially when the protrusions of the spike are worn down.
Figure 4B:
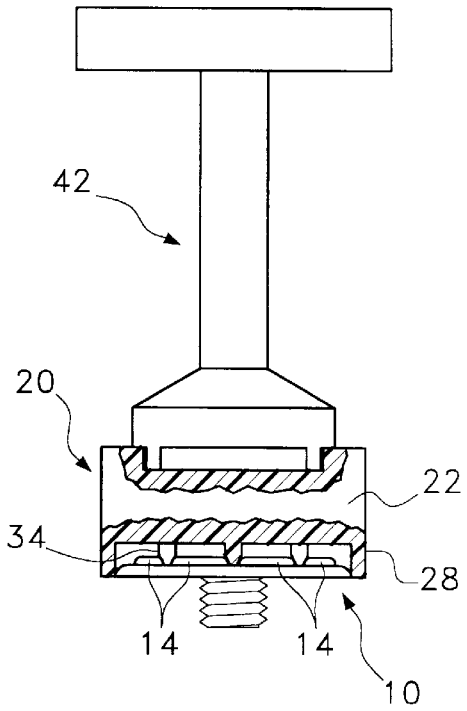

Referring collectively to FIGS. 2A–2D, an embodiment of a wrench style hand-tool according to the present invention, for threading and unthreading soft golf spikes in and out of the heel and/or sole of a golf shoe is shown and designated by the numeral 20. The wrench 20 can be used alone by gripping it manually or in conjunction with a detachable, existing T-handle spike wrench as shown in FIGS. 4A and 4B.

Referring again to FIGS. 2A–2D, the wrench 20 comprises a circular body 22 having a generally planar first end surface 24, a generally planar second end surface 26 (visible in FIGS. 2B and 2C only) and a cylindrical wall 28 depending from the second planar surface 26 of the body 22. The body 22 and the cylindrical wall 28 define a cylindrical outer side surface 30 of the wrench 20 which is optionally provided with flutes 32 (visible in FIG. 2A only) or other like means which facilitate gripping of the wrench 20 when it is used alone.

Figure 2A:
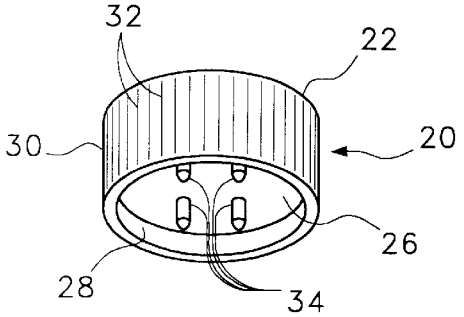
FIG. 2A is a perspective view of an embodiment of the wrench of the present invention.
Figure 2B:
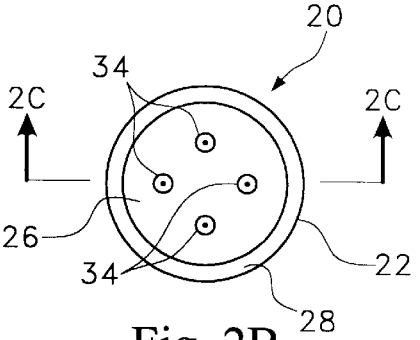
FIG. 2B is a bottom plan view of the wrench of FIG. 2A.

Four spike-driving prongs 34 project from the second planar end surface 26 of the body 22 and are arranged in a square-like formation as best seen in FIGS. 2A and 2B. Although four spike-driving prongs are preferred in the present invention, as few as two spike-driving prongs and as many as eight spike-driving prongs can be employed in the wrench of the present invention if desired. It is most desirable, however, that at least three spike-driving prongs 34 be employed in the present invention since this enables the transfer of more torque to a soft golf spike than existing hand-tools which typically have only two prongs.

Figure 1A:
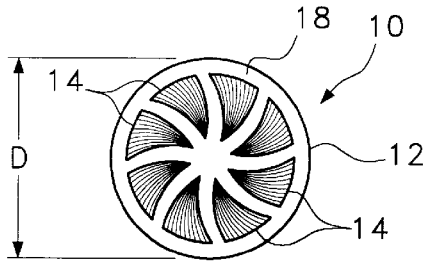
Fig. 1A (PRIOR ART)
FIG. 1A is a top plan view of a soft golf spike which the wrench of the present invention has been intended to be used for in threading and unthreading the spike in or out of a conventional golf shoe.
Figure 1B:
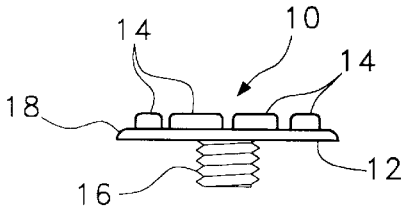
Fig. 1B (PRIOR ART)
FIG. 1B is a side plan view of an unworn soft golf spike.
Figure 1C:
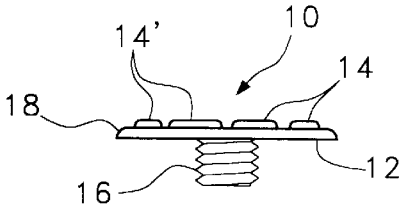
Fig. 1C (PRIOR ART)
FIG. 1C is a side plan view of a worn down soft golf spike.
Figure 2C:
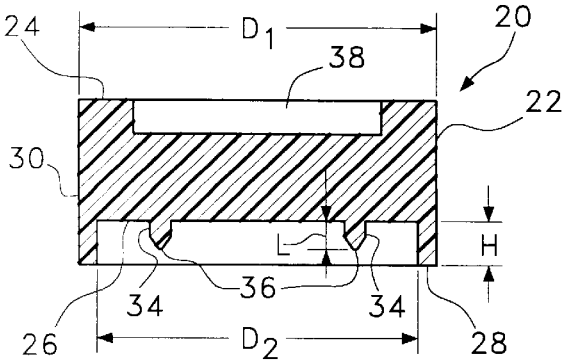
FIG. 2C is a cross-sectional side view through line 2C—2C in FIG. 2B.

In any case, as depicted in FIG. 2C, each spike-driving prong 34 has a length L of approximately ⅛" to ¾" and a sharp pointed tip 36 which allows the prong 34 to penetrate into the soft plastic base 12 of the soft golf spike 10 and any dirt that may have accumulated between the protrusions 14 of the spike 10. This enables the wrench 20 of the present invention to securely grip and rotate even very worn and dirty soft golf spikes like the spike 10 shown in FIG. 1C. This is unlike existing wrenches which have spike-driving prongs that slip out between the worn down, shallow protrusions because the prongs have blunt tips that can not penetrate the soft plastic base 12 of a worn soft golf spike.

Referring still to FIG. 2C, the circular body 22 and cylindrical wall 28 define an outer diameter $D_1$ of approximately 1". The cylindrical wall 28 also defines an inner diameter $D_2$ of just over ⅞" and a height H of approximately 3/16" to 13/16". The height H of the cylindrical wall 28 is always maintained at approximately 1/16" to ⅛" greater than the length L of the prongs 34.

Figure 2D:
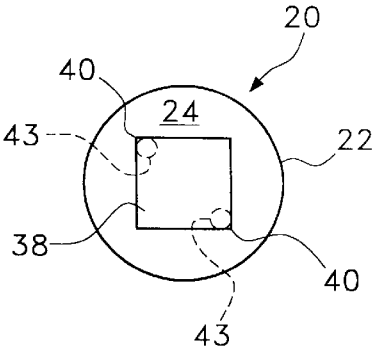
FIG. 2D is a top plan view of the wrench of FIG. 2A.

Referring to FIGS. 2C and 2D, the first planar end surface 24 of the circular body 22 defines a square-shaped recess 38. The recess 38 is sized to receive the prongs 43 (shown with broken lines in FIG. 2D) of an existing T-handle spike wrench 42 when additional torque is required to turn the wrench 20, such as when a worn or damaged soft golf spike needs to be removed from a golf shoe. As shown in FIG. 2D, the corners 40 of the recess operate to receive the prongs 43 of the existing spike wrench. FIGS. 4A and 4B show the T-handle spike wrench 42 removably attached to the wrench 20 via the recess 38. It should be understood, however, that apertures and other like slots can be used to receive the prongs of an existing T-handle spike wrench. Moreover, the recess 38 can also be sized to receive a conventional rachet or other like device which can provide additional rotational torque.

Figure 3A:
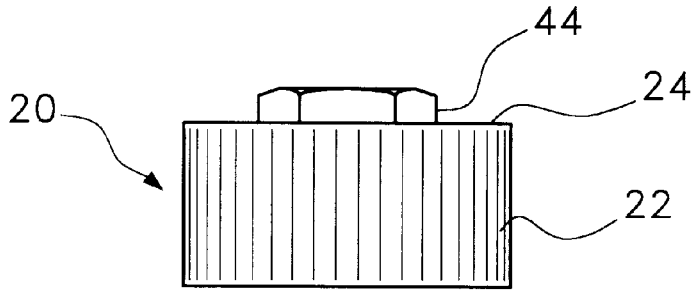
FIG. 3A is a side plan view of a second embodiment of the wrench of the present invention.

In another embodiment of the present invention such as the one shown in FIG. 3A where like elements are identified by like numerals, a nut-shaped projection 44 having four or six sides replaces the recess described in the embodiment above. The projection 44 is integrally attached or unitarily formed with the first planar end surface 24 of the circular body. Such a projection would allow a standard open or boxed end wrench to be used to rotate the wrench 20.

Figure 3B:
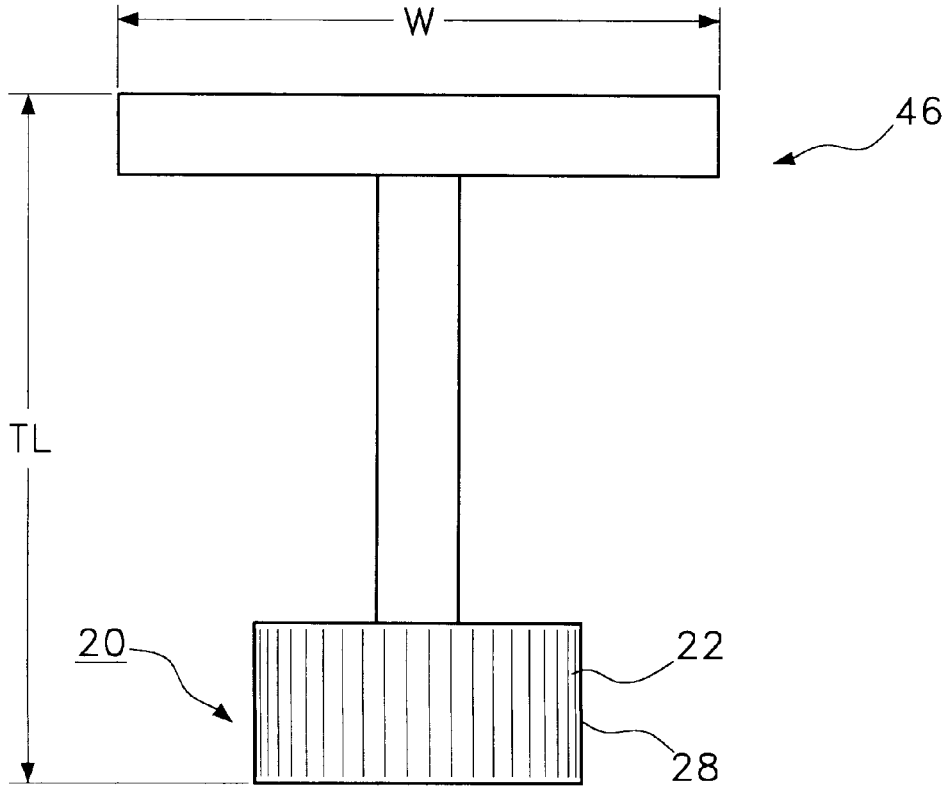
FIG. 3B is a side plan view of a third embodiment of the wrench of the present invention.

FIG. 3B depicts still another embodiment of the wrench of the present invention where like elements are identified by like numerals. In this embodiment, the recess in the first planar end surface is replaced by a unitarily formed or integrally attached T-shaped handle 46. The wrench of this embodiment has an overall tool-length TL of approximately 4"and a handle width W of approximately 3.5". Such dimensions makes the wrench relatively easy and convenient to transport and store in a conventional sports bag or store in a locker.

All embodiments of the wrench according to the present invention are preferably fabricated from any suitably rigid plastic material. This enables the wrench to be inexpensively manufactured and rustproof. It should be understood, however, the wrench can be fabricated from a metallic material if desirable.

FIGS. 4A and 4B, depict how the cylindrical wall 28, which is employed in all embodiments of the present invention, operates to automatically align the working end of the wrench 20 over a soft golf spike especially when the protrusions of the spike are worn down. More specifically, as the wrench 20 is installed onto the spike 10 as shown in FIG. 4A, the cylindrical wall 28 of the wrench 20 contacts the spike first, on its beveled edge 18, because the height H of the cylindrical wall 28 is greater than the length L of the prongs 34. As the cylindrical wall 28 of the wrench 20 slides down the beveled edge 18 of the spike 10, the working end of the wrench automatically aligns itself over the spike 10. Since the inner diameter $D_2$ of the cylindrical wall 28 is slightly greater than the outer diameter D of the base 12 of the spike 10, the spike 10 enters the working end of the wrench 20 in a telescoping manner. The wrench 20 is then pressed down onto the spike 10 so that the sharp-pointed tips 36 of the prongs 34 penetrate the spike 10, thereby fully seating the wrench 20 on the spike 10 as shown in FIG. 4B. Accordingly, the wrench 20 can securely grip and rotate even very worn and dirty soft golf spikes which need to be replaced.

It should be understood that the embodiments described herein are merely exemplary and that a person skilled in the art may make many variations and modifications to the disclosed embodiments utilizing functionally equivalent elements to those described herein. Any and all such variations or modifications as well as others which may become apparent to those skilled in the art, are intended to be included within the scope of the invention as defined by the appended claims.

What is claimed is:

1. A wrench for threading and unthreading soft golf spikes in and out of golf shoes, comprising:

a circular body having a first end surface, a second end surface;

at least three substantially parallel pointed prongs projecting orthogonally from said second end surface; and self-aligning means for automatically aligning said at least three pointed prongs of said wrench over a soft golf spike to be threaded or unthreaded in or out of a golf shoe.

2. The wrench according to claim 1, wherein said circular body and said self-aligning means define a cylindrical outer side surface and further comprising gripping means disposed on said cylindrical outer side surface for enabling a user to grip and rotate said wrench.

3. The wrench according to claim 1, further comprising male-end receiving means defined in said first end surface for receiving a detachable drive handle.

4. The wrench according to claim 1, further comprising a drive handle extending from said first end surface.

5. The wrench according to claim 1, wherein said at least three prongs comprise four prongs.

6. The wrench according to claim 5, wherein said four prongs arranged in a square-shaped formation.

7. A wrench for threading and unthreading soft golf spikes in and out of golf shoes, comprising:

a circular body having a first end surface, a second end surface;

at least three substantially parallel pointed prongs projecting orthogonally a predetermined length from said second end surface; and a cylindrical wall depending from said second end surface for automatically aligning said at least three prongs of said wrench over a soft golf spike to be threaded or unthreaded in or out of a golf shoe.

8. The wrench according to claim 7, wherein said cylindrical wall has a predetermined height which is greater than said predetermined length of said at least three prongs.

9. The wrench according to claim 7, wherein said cylindrical wall has a predetermined inner diameter that enables the spike to be received within said cylindrical wall in a telescopic manner thereby automatically aligning said at least three prongs over the spike.

10. The wrench according to claim 7, wherein said circular body and said cylindrical wall define a cylindrical outer side surface and further comprising gripping means disposed on said cylindrical outer side surface for enabling a user to grip and rotate said wrench.

11. The wrench according to claim 7, further comprising male-end receiving means defined in said first end surface for receiving a detachable drive handle.

12. The wrench according to claim 7, further comprising a drive handle extending from said first end surface.

13. The wrench according to claim 7, wherein said at least three prongs comprise four prongs.

14. The wrench according to claim 13, wherein said four prongs arranged in a square-shaped formation.

15. A wrench for threading and unthreading soft golf spikes in and out of golf shoes, comprising:

a circular body having a first end surface, a second end surface;

a plurality of substantially parallel prongs projecting orthogonally a predetermined length from said second end surface, wherein each of said prongs has a sharp pointed tip for penetrating a soft golf spike; and a cylindrical wall depending from said second end surface for automatically aligning said prongs of said wrench over a soft golf spike to be threaded or unthreaded in or out of a golf shoe.

16. The wrench according to claim 15, wherein said cylindrical wall has a predetermined height which is greater than said predetermined length of said prongs and said cylindrical wall has a predetermined inner diameter that enables the spike to be received within said cylindrical wall in a telescopic manner thereby automatically aligning said prongs over the spike.

17. The wrench according to claim 15, wherein said circular body and said cylindrical wall define a cylindrical outer side surface and further comprising gripping means disposed on said cylindrical outer side surface for enabling a user to grip and rotate said wrench.

18. The wrench according to claim 15, further comprising male-end receiving means defined in said first end surface for receiving a detachable drive handle.

19. The wrench according to claim 15, further comprising a drive handle extending from said first end surface.

* * * * *